US008766899B2

(12) United States Patent
Hsu et al.

(10) Patent No.: US 8,766,899 B2
(45) Date of Patent: Jul. 1, 2014

(54) ACTIVE LIQUID CRYSTAL DISPLAY PANEL

(75) Inventors: Wei-Chun Hsu, Hsin-Chu (TW); Yu-Hsin Ting, Hsin-Chu (TW); Chung-Lin Fu, Hsin-Chu (TW); Tsao-Wen Lu, Hsin-Chu (TW); Nan-Ying Lin, Hsin-Chu (TW); Pei-Hua Chen, Hsin-Chu (TW)

(73) Assignee: AU Optronics Corp., Hsin-Chu (TW)

( * ) Notice: Subject to any disclaimer, the term of this patent is extended or adjusted under 35 U.S.C. 154(b) by 195 days.

(21) Appl. No.: 13/087,328

(22) Filed: Apr. 14, 2011

(65) Prior Publication Data

US 2012/0146962 A1 Jun. 14, 2012

(30) Foreign Application Priority Data

Dec. 10, 2010 (TW) ..... 99143269 A

(51) Int. Cl.
*G09G 3/36* (2006.01)
*G09G 5/00* (2006.01)

(52) U.S. Cl.
USPC ..... 345/98; 345/100; 345/92

(58) Field of Classification Search
None
See application file for complete search history.

(56) References Cited

U.S. PATENT DOCUMENTS

| | | | | |
|---|---|---|---|---|
| 4,975,691 | A * | 12/1990 | Lee | 345/79 |
| 5,248,963 | A | 9/1993 | Yasui | |
| 2002/0053897 | A1* | 5/2002 | Kajiwara et al. | 323/272 |
| 2008/0284710 | A1* | 11/2008 | Kimura et al. | 345/98 |
| 2009/0322737 | A1 | 12/2009 | Kim | |
| 2011/0069059 | A1* | 3/2011 | Lee et al. | 345/212 |
| 2011/0115772 | A1* | 5/2011 | Chung | 345/211 |
| 2011/0261095 | A1* | 10/2011 | Missbach | 345/698 |

* cited by examiner

*Primary Examiner* — Amare Mengistu
*Assistant Examiner* — Yaron Cohen
(74) *Attorney, Agent, or Firm* — Winston Hsu; Scott Margo

(57) ABSTRACT

An active liquid crystal display panel includes a pixel array, a gate driving circuit, a data driving circuit, and an analog buffer. The gate driving circuit is used for driving M first scan lines where M is a natural number. The analog buffer is coupled to the gate driving circuit and includes M buffer circuits and a regulator. Each buffer circuit drives a corresponding second scan line according to an output signal of a corresponding first scan line of the M first scan lines, and the regulator is used for maintaining at least one reference voltage supplied to the M buffer circuits.

8 Claims, 5 Drawing Sheets

ACTIVE LIQUID CRYSTAL DISPLAY PANEL

BACKGROUND OF THE INVENTION

1. Field of the Invention

The present invention is related to an active liquid crystal display panel, and particularly to an active liquid crystal display panel capable of maintaining voltages of output terminals of a gate driving circuit.

2. Description of the Prior Art

Please refer to FIG. 1. FIG. 1 is a diagram illustrating an active liquid crystal display panel 100. Generally speaking, the active liquid crystal display panel 100 produced by a low temperature poly-silicon (LTPS) process includes M scan lines G1-Gm, N data lines D1-Dn, a pixel array 102, a gate driving circuit 104, and a data driving circuit 106, where analog buffers b1-bm are disposed at output terminals of the gate driving circuit 104 for increasing driving capability, and a system provides a highest voltage VGH and a lowest voltage VGL for the analog buffers b1-bm. However, after the active liquid crystal display panel 100 is powered down for a period of time, residual charges stored in the active liquid crystal display panel 100 are gradually released. Therefore, undetermined voltage nodes are formed between the analog buffers b1-bm and the output terminals of the gate driving circuit 104 due to leakage currents. When the active liquid crystal display panel 100 is powered on again, due to the undetermined voltage nodes, a voltage drop between the first voltage VGH and the second voltage VGL maybe insufficient, resulting in the active liquid crystal display panel 100 displaying an abnormal frame.

SUMMARY OF THE INVENTION

An embodiment provides an active liquid crystal display panel. The active liquid crystal display panel includes a pixel array, a gate driving circuit, a data driving circuit, and an analog buffer. The pixel array has a plurality of pixels. The gate driving circuit is used for driving M first scan lines, wherein M is a natural number. The data driving circuit is used for converting display data into a plurality of data voltages and driving N data lines, where an output signal of each data line is used for charging/discharging a pixel corresponding to the data line to a predetermined voltage according to a data voltage of the plurality of data voltages. The analog buffer coupled to the gate driving circuit includes M buffer circuits and a regulator, where each buffer circuit drives a corresponding second scan line according to an output signal of a corresponding first scan line, and an output signal of the second scan line is used for controlling turning-on and turning-off of a switch coupled to a pixel, where the regulator is used for maintaining at least one reference voltage supplied to the M buffer circuits.

The present invention provides an active liquid crystal display panel. The active liquid crystal display panel utilizes a regulator to keep a first voltage at about the same voltage as a first reference voltage, and a second voltage at about the same voltage as a second reference voltage. Therefore, when a leakage path appears between the first voltage and the second voltage, resulting in a voltage drop between the first voltage and the second voltage being decreased, the regulator can keep the first voltage at about the same voltage as the first reference voltage, and the second voltage at about the same voltage as the second reference voltage. Therefore, the present invention can prevent the active liquid crystal display panel from displaying an abnormal frame resulting from the voltage drop between the first voltage and the second voltage being insufficient.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
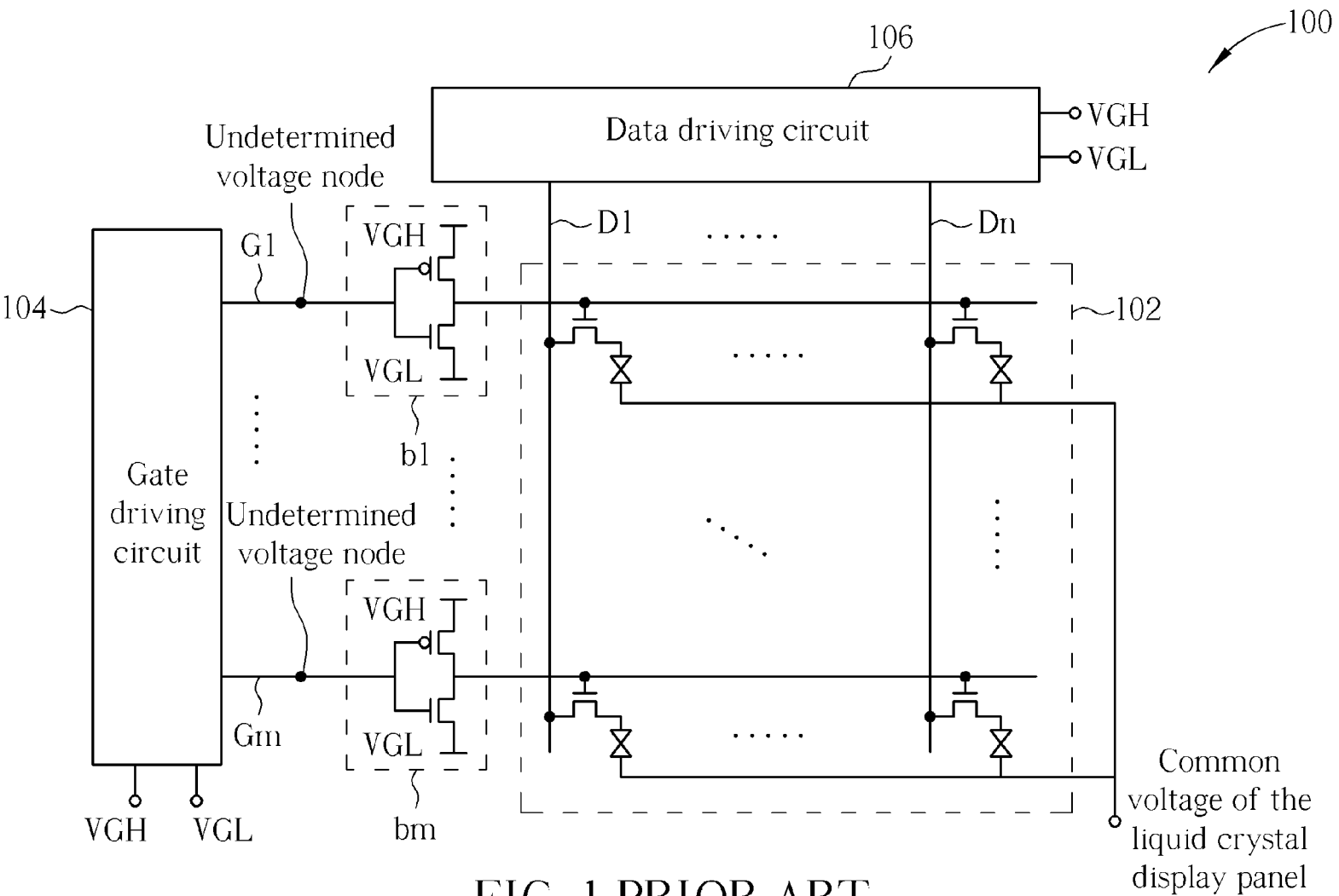
FIG. 1 PRIOR ART
FIG. 1 is a diagram illustrating an active liquid crystal display panel.
Figure 2:
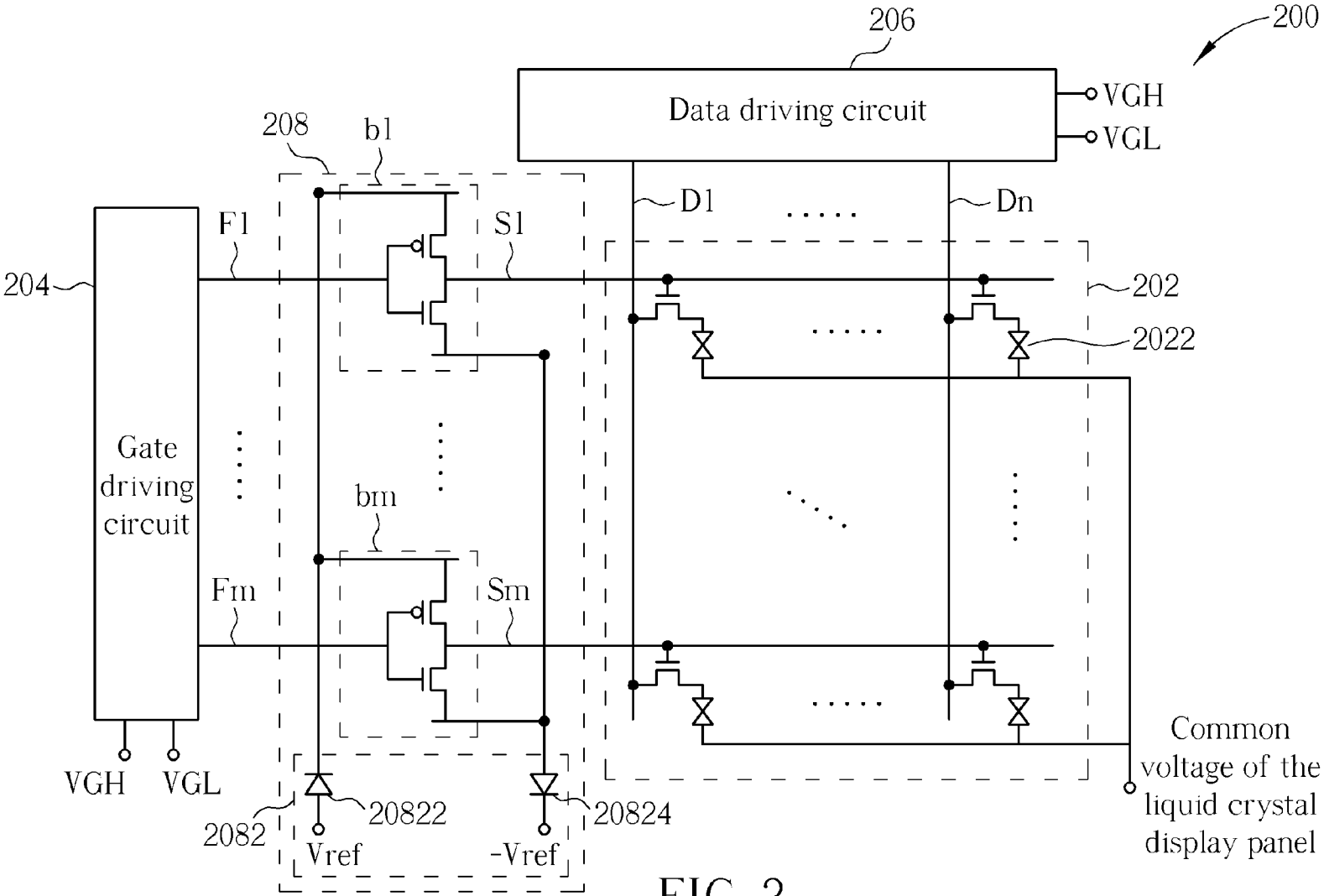
FIG. 2 is a diagram illustrating an active liquid crystal display panel according to an embodiment.

Please refer to FIG. 2. FIG. 2 is a diagram illustrating an active liquid crystal display panel 200 according to an embodiment. The active liquid crystal display panel 200 includes a pixel array 202, a gate driving circuit 204, a data driving circuit 206, and an analog buffer 208. The pixel array 202 includes a plurality of pixels 2022. The gate driving circuit 204 is used for driving M first scan lines F1-Fm, wherein M is a natural number. The data driving circuit 206 is used for converting display data into a plurality of data voltages and driving N data lines D1-Dn, where N is a natural number and an output signal of each data line is used for charging/discharging a pixel corresponding to the data line to a predetermined voltage according to a data voltage of the plurality of data voltages. The analog buffer 208 is coupled to the gate driving circuit 204 and includes M buffer circuits b1-bm and a regulator 2082. The buffer circuit bi is used for driving a corresponding second scan line Si according to an output signal of a corresponding first scan line Fi, and an output signal of the second scan line Si is used for controlling turning-on and turning-off of a switch coupled to a pixel 2022, where $1 \leq i \leq M$ and i is a natural number. In addition, the regulator 2082 is used for maintaining a first voltage VGH and a second voltage VGL supplied to the M buffer circuits b1-bm.

Figure 3:
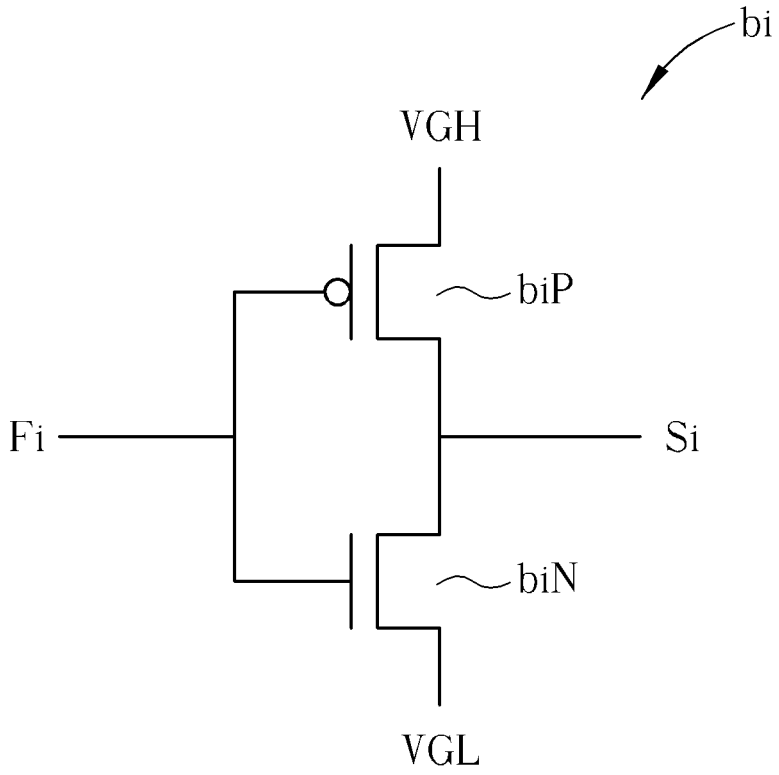
FIG. 3 is a diagram illustrating the buffer circuit.

Please refer to FIG. 3. FIG. 3 is a diagram illustrating the buffer circuit bi. The buffer circuit bi has a first terminal coupled to the corresponding first scan line Fi, a second terminal coupled to the second scan line Si, a third terminal for receiving the first voltage VGH, and a fourth terminal for receiving the second voltage VGL. The buffer circuit bi includes a P-type thin film transistor biP and an N-type thin film transistor biN. The P-type thin film transistor biP has a first terminal coupled to a third terminal of the buffer circuit bi, a second terminal coupled to a first terminal of the buffer circuit bi, and a third terminal coupled to a second terminal of the buffer circuit bi. The N-type thin film transistor biN has a first terminal coupled to the second terminal of the buffer circuit bi, a second terminal coupled to the first terminal of the buffer circuit bi, and a third terminal coupled to a fourth terminal of the buffer circuit bi.

As shown in FIG. 2 and FIG. 3, the regulator 2082 includes a first diode 20822 and a second diode 20824. The first diode

20822 has an anode terminal for receiving the first reference voltage Vref, and a cathode terminal coupled to the third terminal of the buffer circuit bi. The second diode 20824 has a cathode terminal for receiving the second reference voltage −Vref, and an anode terminal coupled to the fourth terminal of the buffer circuit bi. The regulator 2082 is integrated in a low temperature poly-silicon (LTPS) process of the active liquid crystal display panel 200, and regulating processes of the regulator 2082 are as follows.

When the active liquid crystal display panel 200 operates normally, the first voltage VGH is higher than the first reference voltage Vref and the second voltage VGL is lower than the second reference voltage −Vref, so the first diode 20822 and second diode 20824 are turned off.

When the first voltage VGH is lower than the first reference voltage Vref, the first diode 20822 is turned on and keeps the first voltage VGH at about the same voltage as the first reference voltage Vref. When the second voltage VGL is higher than the second reference voltage −Vref, the second diode 20824 is turned on and keeps the second voltage VGL at about the same voltage as the second reference voltage −Vref.

In addition, range of the first reference voltage Vref and range of the second reference voltage −Vref are determined according to equations (1) and (2):

$$\text{The ground} \leq \text{the first reference voltage Vref} \leq \text{the first voltage VGH} \quad (1)$$

$$\text{The second voltage } VGL \leq \text{the second reference voltage } -Vref \leq \text{the ground} \quad (2)$$

Figure 4A:
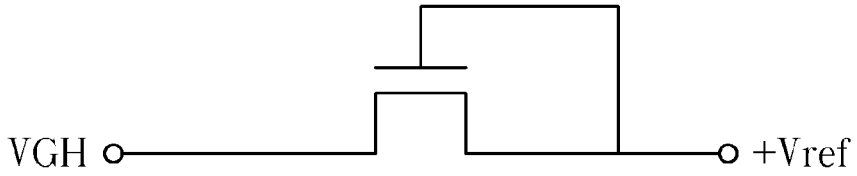
FIG. 4A, FIG. 4B, FIG. 4C and FIG. 4D are diagrams illustrating the first diode according to different embodiments.
Figure 4B:
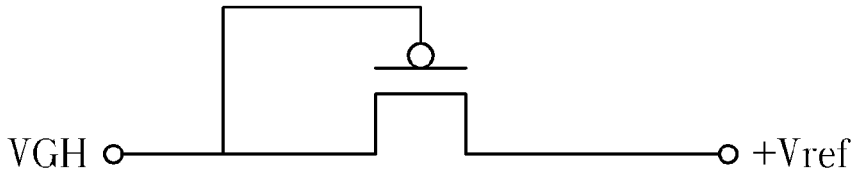
Figure 4C:
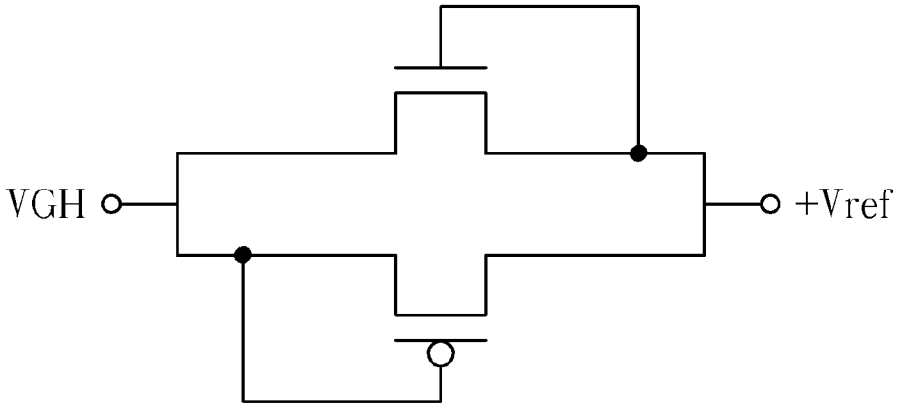
Figure 4D:
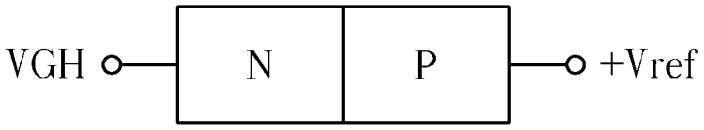

Please refer to FIG. 4A, FIG. 4B, FIG. 4C and FIG. 4D. FIG. 4A, FIG. 4B, FIG. 4C and FIG. 4D are diagrams illustrating the first diode 20822 according to different embodiments. As shown in FIG. 4A, the first diode 20822 is a diode-connected N-type thin film transistor. As shown in FIG. 4B, the first diode 20822 is a diode-connected P-type thin film transistor. As shown in FIG. 4C, the first diode 20822 is the diode-connected N-type thin film transistor of FIG. 4A coupled to the diode-connected P-type thin film transistor of FIG. 4B. As shown in FIG. 4D, the first diode 20822 is a PN junction.

Figure 5A:
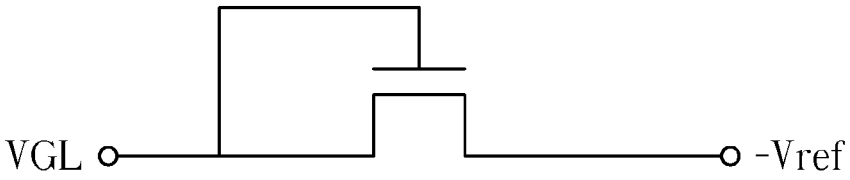
FIG. 5A, FIG. 5B, FIG. 5C, and FIG. 5D are diagrams illustrating the second diode according to different embodiments.
Figure 5B:
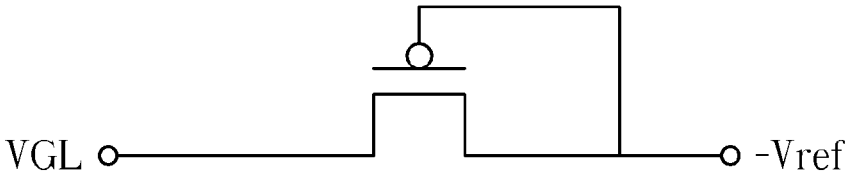
Figure 5C:
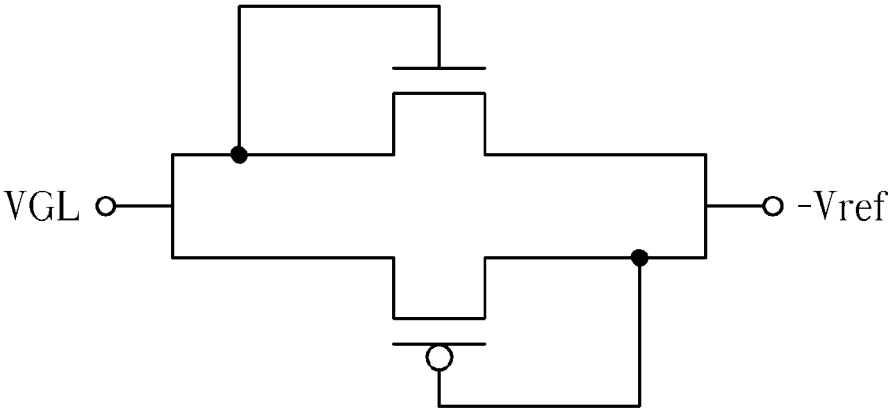
Figure 5D:
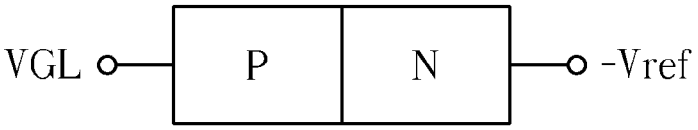

Please refer to FIG. 5A, FIG. 5B, FIG. 5C, and FIG. 5D. FIG. 5A, FIG. 5B, FIG. 5C, and FIG. 5D are diagrams illustrating the second diode 20824 according to different embodiments. As shown in FIG. 5A, the second diode 20824 is a diode-connected N-type thin film transistor. As shown in FIG. 5B, the second diode 20824 is a diode-connected P-type thin film transistor. As shown in FIG. 5C, the second diode 20824 is the diode-connected N-type thin film transistor of FIG. 4A coupled to the diode-connected P-type thin film transistor of FIG. 4B. As shown in FIG. 5D, the second diode 20824 is a PN junction.

To sum up, the active liquid crystal display panel utilizes the regulator to keep the first voltage at about the same voltage as the first reference voltage, and the second voltage at about the same voltage as the second reference voltage. Therefore, when a leakage path appears between the first voltage and the second voltage, resulting in a voltage drop between the first voltage and the second voltage being decreased, the regulator can keep the first voltage at about the same voltage as the first reference voltage, and the second voltage at about the same voltage as the second reference voltage. Therefore, the present invention can prevent the active liquid crystal display panel from displaying an abnormal frame resulting from the voltage drop between the first voltage and the second voltage being insufficient.

Those skilled in the art will readily observe that numerous modifications and alterations of the device and method may be made while retaining the teachings of the invention.

What is claimed is:

1. An active liquid crystal display panel comprising:

a pixel array comprising a plurality of pixels;

a gate driving circuit for driving M first scan lines, wherein M is a natural number;

a data driving circuit for converting display data into a plurality of data voltages and driving N data lines, wherein an output signal of each data line is used for charging/discharging a pixel corresponding to the data line to a predetermined voltage according to a data voltage of the plurality of data voltages; and an analog buffer coupled to the gate driving circuit comprising:

M buffer circuits, each buffer circuit comprising:

a P-type thin film transistor having a first terminal, a second terminal directly coupled to a first scan line, and a third terminal directly coupled to a second scan line corresponding to the first scan line, the second scan line being configured to control turning-on and turning-off of a switch coupled to a pixel; and an N-type thin film transistor having a first terminal directly coupled to the second scan line, a second terminal directly coupled to the first scan line, and a third terminal; and a regulator comprising:

a first diode having an anode terminal configured to receive a first reference voltage, and a cathode terminal directly coupled to the first terminal of the P-type thin film transistor; and a second diode having a cathode terminal configured to receive a second reference voltage, and an anode terminal directly coupled to the third terminal of the N-type thin film transistor.

2. The active liquid crystal display panel of claim 1, wherein when a voltage at the first terminal of the P-type thin film transistor is lower than the first reference voltage, the first diode is turned on.

3. The active liquid crystal display panel of claim 1, wherein when a voltage at the third terminal of the N-type thin film transistor is higher than the second reference voltage, the second diode is turned on.

4. The active liquid crystal display panel of claim 1, wherein the regulator is integrated in a low temperature poly-silicon (LTPS) process.

5. An active liquid crystal display panel comprising:

a pixel array comprising a plurality of pixels;

a gate driving circuit for driving M first scan lines, wherein M is a natural number;

a data driving circuit for converting display data into a plurality of data voltages and driving N data lines, wherein an output signal of each data line is used for charging/discharging a pixel corresponding to the data line to a predetermined voltage according to a data voltage of the plurality of data voltages; and an analog buffer coupled to the gate driving circuit comprising:

M buffer circuits, each buffer circuit consisting of:

a P-type thin film transistor having a first terminal, a second terminal directly coupled to a first scan line, and a third terminal directly coupled to a second scan line corresponding to the first scan line, the second scan line being configured to control turning-on and turning-off of a switch coupled to a pixel; and an N-type thin film transistor having a first terminal directly coupled to the second scan line, a second terminal directly coupled to the first scan line, and a third terminal; and a regulator consisting of:

a first diode having an anode terminal configured to receive a first reference voltage, and a cathode terminal directly coupled to the first terminal of the P-type thin film transistor; and a second diode having a cathode terminal configured to receive a second reference voltage, and an anode terminal directly coupled to the third terminal of the N-type thin film transistor.

6. The active liquid crystal display panel of claim 5, wherein when a voltage at the first terminal of the P-type thin film transistor is lower than the first reference voltage, the first diode is turned on.

7. The active liquid crystal display panel of claim 5, wherein when a voltage at the third terminal of the N-type thin film transistor is higher than the second reference voltage, the second diode is turned on.

8. The active liquid crystal display panel of claim 5, wherein the regulator is integrated in a low temperature polysilicon (LTPS) process.

* * * * *